US009484151B2

(12) United States Patent
Kuniyoshi

(10) Patent No.: US 9,484,151 B2
(45) **Date of Patent: *Nov. 1, 2016**

(54) METHOD OF PRODUCING R-T-B SINTERED MAGNET

(75) Inventor: Futoshi Kuniyoshi, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 547 days.

This patent is subject to a terminal disclaimer.

(21) Appl. No.: 13/977,125

(22) PCT Filed: Jan. 19, 2012

(86) PCT No.: PCT/JP2012/051032

§ 371 (c)(1),
(2), (4) Date: Jun. 28, 2013

(87) PCT Pub. No.: WO2012/099186

PCT Pub. Date: Jul. 26, 2012

(65) Prior Publication Data

US 2013/0299050 A1 Nov. 14, 2013

(30) Foreign Application Priority Data

Jan. 19, 2011 (JP) ..... 2011-009186

(51) Int. Cl.
*H01F 41/00* (2006.01)
*B22F 3/12* (2006.01)
(Continued)

(52) U.S. Cl.
CPC ..... *H01F 41/005* (2013.01); *B22F 3/12* (2013.01); *B22F 3/24* (2013.01); *C22C 28/00* (2013.01); *C22C 33/0278* (2013.01);
(Continued)

(58) Field of Classification Search
CPC ..... H01F 41/0293; H01F 1/0577; B22F 3/10
See application file for complete search history.

(56) References Cited

U.S. PATENT DOCUMENTS

2008/0006345 A1 1/2008 Machida et al.
2008/0223489 A1 9/2008 Nagata et al.
(Continued)

FOREIGN PATENT DOCUMENTS

JP 63-219548 A 9/1988
JP 2004296973 A * 10/2004
(Continued)

OTHER PUBLICATIONS

Translation of JP2004-296973A, Oct. 2004.*
Machine translation of JP2006-303197A, Nov. 2006.*
Translation of JP2009-194262A, Aug. 2009.*
English translation of Official Communication issued in corresponding International Application PCT/JP2012/051032, mailed on Aug. 1, 2013.
(Continued)

*Primary Examiner* — Jie Yang
*Assistant Examiner* — Xiaowei Su
(74) *Attorney, Agent, or Firm* — Keating & Bennett, LLP

(57) ABSTRACT

A method for producing a sintered R-T-B based magnet includes providing at least one sintered R-T-B based magnet material (where R is a rare-earth element and T is Fe or Fe and Co); providing RH diffusion sources that include a heavy rare-earth element RH (which is Dy and/or Tb) and 30 to 80 mass % of Fe and that have a particle size between 53 μm and 5600 μm; arranging the magnet material and the RH diffusion sources in a process vessel so that some of the RH diffusion sources are in contact with the magnet material; performing an RH diffusion process by heat treating in an inert ambient at a pressure of 5000 Pa or less and at a temperature of 800° C. to 1000° C.; and separating the RH diffusion sources from the magnet material.

1 Claim, 4 Drawing Sheets

(51) Int. Cl.

| | |
|---|---|
| ***B22F 3/24*** | (2006.01) |
| ***C22C 28/00*** | (2006.01) |
| ***C22C 33/02*** | (2006.01) |
| ***C22C 38/00*** | (2006.01) |
| ***H01F 41/02*** | (2006.01) |
| ***C22F 1/16*** | (2006.01) |
| ***C22C 38/06*** | (2006.01) |
| ***C22C 38/10*** | (2006.01) |
| ***C22C 38/16*** | (2006.01) |
| *H01F 1/057* | (2006.01) |

(52) U.S. Cl.

CPC ..... *C22C 38/00* (2013.01); *C22C 38/002* (2013.01); *C22C 38/005* (2013.01); *C22C 38/06* (2013.01); *C22C 38/10* (2013.01); *C22C 38/16* (2013.01); *C22F 1/16* (2013.01); *H01F 41/0293* (2013.01); *B22F 2003/248* (2013.01); *H01F 1/0577* (2013.01)

(56) References Cited

U.S. PATENT DOCUMENTS

| | | | | |
|---|---|---|---|---|
| 2008/0286595 | A1 | 11/2008 | Yoshimura et al. | |
| 2009/0252865 | A1 | 10/2009 | Sagawa | |
| 2009/0297699 | A1 | 12/2009 | Baba et al. | |
| 2013/0087248 | A1* | 4/2013 | Kuniyoshi ..... | B22F 3/24 148/101 |

FOREIGN PATENT DOCUMENTS

| | | | | |
|---|---|---|---|---|
| JP | 2006-303197 | A | | 11/2006 |
| JP | 2007-258455 | A | | 10/2007 |
| JP | 2009194262 | A | * | 8/2009 |

OTHER PUBLICATIONS

Official Communication issued in International Patent Application No. PCT/JP2012/051032, mailed on Apr. 24, 2012.

* cited by examiner

METHOD OF PRODUCING R-T-B SINTERED MAGNET

TECHNICAL FIELD

The present invention relates to a method for producing a sintered R-T-B based magnet including, as a main phase, an $R_2T_{14}B$ type compound (where R is a rare-earth element and T is either Fe or Fe and Co).

BACKGROUND ART

A sintered R-T-B based magnet, including an $R_2T_{14}B$ type compound as a main phase, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity $H_{cJ}$ (which will be simply referred to herein as "$H_{cJ}$") at high temperatures, such a magnet will cause an irreversible flux loss. For that reason, when used in a motor, for example, the magnet should maintain coercivity that is high enough even at elevated temperatures to minimize the irreversible flux loss.

It has been known that if RP in the $R_2T_{14}B$ type compound phase of a sintered R-T-B based magnet is replaced with a heavy rare-earth element RH (Dy, Tb), the coercivity will increase. To achieve high coercivity even at a high temperature, it is effective to add a lot of such a heavy rare-earth element RH to the sintered R-T-B based magnet. However, if the light rare-earth element RL (Nd, Pr) of the sintered R-T-B based magnet is replaced with the heavy rare-earth element RH, the coercivity will certainly increase but the remanence $B_r$ (which will be simply referred to herein as "$B_r$") will decrease instead. Furthermore, as the heavy rare-earth element RH is one of rare natural, resources, its use should be cut down.

For these reasons, various methods for increasing the coercivity of a sintered R-T-B based magnet effectively with the addition of as small an amount of the heavy rare-earth element RH as possible have recently been researched and developed in order to avoid decreasing $B_r$. The applicant of the present application already disclosed, in Patent Document No. 1, a method for diffusing a heavy rare-earth element RH such as Dy from the surface of a sintered R-T-B based magnet body deep inside the magnet while supplying the heavy rare-earth element RH onto the surface of the sintered R-T-B based magnet body (which will be referred to herein as an "evaporation diffusion process").

The applicant of the present application also proposed, in Patent Document No. 2, a method for diffusing RH from an RH diffusion source, which is either foil or powder that contains RH, into a sintered R-T-B based magnet body by carrying out a heat treatment with the foil or powder brought in contact with the surface of the sintered R-T-B based magnet body. According to the method disclosed in Patent Document No. 2, if the RH diffusion source is foil, then the foil has a thickness of 1 to 50 μm. On the other hand, if the RH diffusion source is powder, a powder layer with a thickness of 1 to 50 μm is formed on the surface of the magnet using powder with a particle size of 1 to 50 μm. In this manner, a small amount of RH can be used efficiently and can be diffused inside of the sintered R-T-B based magnet body. In one example, pure Dy was used as the RH diffusion source.

Meanwhile, Patent Document No. 3 discloses a method in which a fine powder of an RH—Fe compound with a mean particle size of 100 nm to 50 μm is used as an RH diffusion source and dispersed in a solvent to obtain slurry and in which a heat treatment is carried out with the slurry applied onto the surface of a sintered R-T-B based magnet body. According to the method of Patent Document No. 3, by using a ferrous compound as the RH diffusion source, $H_{cJ}$ can be increased significantly. In addition, since the melting point decreases around the eutectic point, the heat treatment temperature can be lowered and the magnet is less affected by a variation in temperature during the heat treatment process. On top of that, by using slurry in which a fine powder of an RH compound with a mean particle size of 100 nm to 50 μm is dispersed in a solvent, an RH compound can be deposited uniformly onto the sintered R-T-B based magnet body. As a result, the RH can be diffused more uniformly through the heat treatment.

Patent Document No. 4 discloses a method for carrying out a heat treatment with a powder of an RH diffusion source, which is an alloy of a rare-earth element and a non-rare-earth element, put on the surface of a sintered R-T-B based magnet body. The powder includes, as its essential elements, a rare-earth element, Fe, Co and various other M elements. In Patent Document No. 4, the powder of the RH diffusion source is also dispersed in either an organic solvent or water and the slurry is also applied onto the surface of the sintered R-T-B based magnet body. According to Patent Document No. 4, the smaller the mean particle size of the powder, the higher the diffusion efficiency should be.

Patent Document No. 5 discloses a method for carrying out a heat treatment with an alloy powder including RH with a particle size of 10 μm or less and an iron group transition element used as an RH diffusion source and with the alloy powder applied onto the surface of a sintered R-T-B based magnet body by barrel painting method, for example.

Patent Document No. 6 says that if an RH oxide layer is formed on the inner surface of a heat treatment vessel and if a heat treatment is carried out with a sintered R-T-B based magnet body arranged in such a heat treatment vessel, then the inner surface of the heat treatment vessel and the sintered magnet body will not adhere or stick to each other even when they are in contact with each other, and Hcj can be increased because RH in the RH oxide layer is reduced and diffuses and enters the sintered magnet.

CITATION LIST

Patent Literature

Patent Document No. 1: PCT International Application Publication No. 2007/102391

Patent Document No. 2: Japanese Laid-Open Patent Publication No. 2007-258455

Patent Document No. 3: Japanese Laid-Open Patent Publication No. 2009-289994

Patent Document No. 4: Japanese Laid-Open Patent Publication No. 2008-263179

Patent Document No. 5: PCT International Application Publication No. 2008/032426

Patent Document No. 6: Japanese Laid-Open Patent Publication No. 63-219548

SUMMARY OF INVENTION

Technical Problem

According to both of the methods disclosed in Patent Documents Nos. 1 and 2, RH can be diffused efficiently without using an organic solvent or tackiness agent. In addition, compared to a sputtering process, RH would not be wasted in vain by being deposited on the inner walls of a heat treatment furnace, for example. The methods disclosed in Patent Documents Nos. 1 and 2 are good methods that can minimize a decrease in $B_r$, because RH does not diffuse easily inside the main phase in a surface region of the magnet.

According to the method disclosed in Patent Document No. 1, however, sintered R-T-B based magnet bodies and RH bulk bodies need to be arranged so as to be spaced apart from each other, and therefore, it takes a lot of trouble in getting the arrangement process step done, which is a problem.

Also, as foil or powder of pure Dy is used according to the method of Patent Document No. 2 as the RH diffusion source, such foil or powder would adhere easily onto the surface of the magnet through the heat treatment. For that reason, such an RH diffusion source is hard to be separated after the heat treatment and non-recyclable, and should be diffused inside the magnet entirely.

According to each of the methods disclosed in Patent Documents Nos. 3 to 5, a powder of an RH diffusion source is applied onto the surface of a sintered R-T-B based magnet body by using an organic component such as an organic solvent or a tackiness agent. Even though the powder application method itself is a simple one, a wet application process step should be performed separately in any case, thus eventually decreasing the productivity accordingly. In addition, since a fine powder with a particle size of 10 μm or less is used as the RH diffusion source, such an RH diffusion source will react with the sintered R-T-B based magnet body to get modified and/or adhere to the sintered R-T-B based magnet body easily. And such an RH diffusion source is also hard to be separated after the heat treatment and non-recyclable, and should be diffused inside the magnet entirely.

According to the method disclosed in Patent Document No. 6, an RH oxide is used as an RH diffusion source in order to prevent the RH diffusion source from adhering to, or being deposited on, the sintered R-T-B based magnet body, thus resulting in poor diffusion efficiency and only a slight increase in $H_{cJ}$.

The present inventors perfected our invention in order to overcome such problems with the related art by providing a method for producing a sintered R-T-B based magnet that can obtain a high $H_{cJ}$ by diffusing a heavy rare-earth element RH such as Dy or Tb from the surface of the sintered R-T-B based magnet material deep inside without causing a decrease in $B_r$. Specifically, an object of the present invention is to provide a method for producing a sintered high $H_{cJ}$ R-T-B based magnet with high productivity by arranging sintered R-T-B based magnet materials and RH diffusion sources in contact with each other by a simple method without performing any troublesome arrangement process step or an application process step that uses a solvent or a tackiness agent, by recycling the RH diffusion sources a number of times without allowing the RH diffusion sources to adhere to the sintered R-T-B based magnet materials, and by diffusing the heavy rare-earth element RH effectively inside the sintered R-T-B based magnet materials.

Solution to Problem

A method for producing a sintered R-T-B based magnet according to the present invention includes the steps of: providing at least one sintered R-T-B based magnet material (where R is a rare-earth element and T is either Fe alone or Fe and Co); providing a plurality of RH diffusion sources each of which includes a heavy rare-earth element RH (which is Dy and/or Tb) and 30 mass % to 80 mass % of Fe and has a particle size of more than 53 μm and equal to or smaller than 5600 μm; performing an arrangement process to arrange the sintered R-T-B based magnet material and the plurality of RH diffusion sources in a process vessel so that some of the RH diffusion sources are in contact with the sintered R-T-B based magnet material; performing an RH diffusion process by carrying out a heat treatment in an inert ambient at a pressure of 5000 Pa or less and at a temperature of 800° C. to 1000° C. in the process vessel on the sintered R-T-B based magnet material with which some of the RH diffusion sources are in contact, on the RH diffusion sources which are in contact with the sintered R-T-B based magnet material, and on the RH diffusion sources which are not in contact with the sintered R-T-B based magnet material; and performing a separation process to separate the plurality of RH diffusion sources from the sintered R-T-B based magnet material after the RH diffusion process has been performed.

In one embodiment, the arrangement process includes arranging the sintered R-T-B based magnet material so that at least a portion of the sintered R-T-B based magnet material is buried in a set of the RH diffusion sources.

In one embodiment, the arrangement process includes arranging the sintered R-T-B based magnet material so that the sintered R-T-B based magnet material is entirely buried in the set of the RH diffusion sources.

In one embodiment, the arrangement process includes arranging a plurality of sintered R-T-B based magnet materials so that at least some of the sintered R-T-B based magnet materials are buried in a set of the RH diffusion sources.

In one embodiment, the arrangement process includes arranging a plurality of sintered R-T-B based magnet materials and then arranging the plurality of RH diffusion sources so as to fill gaps between the sintered R-T-B based magnet materials.

In one embodiment, the arrangement process includes arranging the plurality of RH diffusion sources and the sintered R-T-B based magnet material using a jig to arrange the RH diffusion sources and the sintered R-T-B based magnet material and then moving the RH diffusion sources and the sintered R-T-B based magnet material along with the jig into the process vessel.

In one embodiment, the RH diffusion process is performed at an ambient pressure of 0.1 Pa or more.

In one embodiment, the separation process includes collecting the plurality of RH diffusion sources that have been used in the RH diffusion process.

In one embodiment, the method includes: performing a second arrangement process to arrange a portion of the sintered R-T-B based magnet material that has not been used in the RH diffusion process and the plurality of RH diffusion sources that have been collected in the separation process in either the process vessel or in another process vessel so that some of the RH diffusion sources are in contact with the sintered R-T-B based magnet material; performing a second RH diffusion process by carrying out a heat treatment in an inert ambient at a pressure of 5000 Pa or less and at a temperature of 800° C. to 1000° C. in either the process vessel or that another process vessel on the sintered R-T-B based magnet material with which some of the RH diffusion sources are in contact, on the RH diffusion sources which are in contact with the sintered R-T-B based magnet material, and on the RH diffusion sources which are not in contact with the sintered R-T-B based magnet material; and performing a second separation process to separate the plurality of RH diffusion sources from the sintered R-T-B based magnet material after the RH diffusion process has been performed.

Advantageous Effects of Invention

According to the present invention, a plurality of RH diffusion sources which have a relatively large particle size of more than 53 μm and which include a heavy rare-earth element RH (which is Dy and/or Tb) and 30 mass % to 80 mass % of Fe are used, and therefore, a sintered R-T-B based magnet material and RH diffusion sources can be arranged to contact with each other by a simple method without performing a troublesome arrangement process or an application process that uses some solvent or tackiness agent. As a result, high productivity can be achieved by omitting such a troublesome arrangement process or such an extra process.

In addition, the RH diffusion sources described above do not adhere to the sintered R-T-B based magnet material easily. That is why the RH diffusion sources can be easily separated from the sintered R-T-B based magnet material and collected after the RH diffusion process. On top of that, since each of the RH diffusion sources has as large a size as more than 53 μm, it is possible to avoid consuming the RH diffusion source entirely through a single RH diffusion process. As a result, the RH diffusion source can be used over and over again.

Furthermore, by performing the RH diffusion process using the RH diffusion sources as a heat treatment in an inert ambient at a pressure of 5000 Pa or less and at a temperature of 800° C. to 1000° C., diffusion from a point of contact between the sintered R-T-B based magnet body and the RH diffusion sources (i.e., contact diffusion) and diffusion of RH that has vaporized and sublimed from the RH diffusion sources that are not in contact with the sintered R-T-B based magnet body (i.e., non contact diffusion) can be advanced at the same time. As a result, the heavy rare-earth element RH can be introduced into the magnet more easily and more appropriately without supplying RH too little or too much.

DESCRIPTION OF EMBODIMENTS

Figure 1:
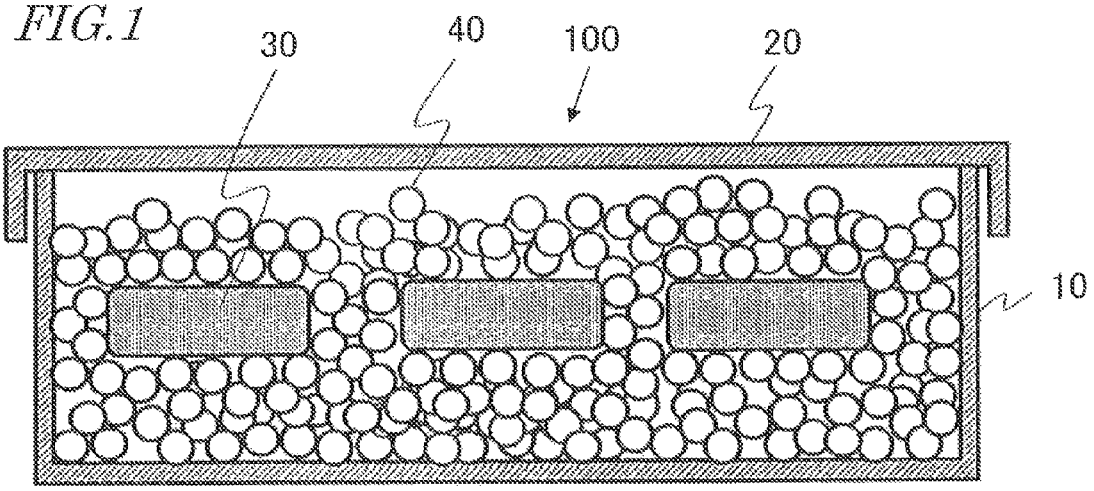
FIG. 1 Illustrates an exemplary arrangement of sintered R-T-B based magnet materials and RH diffusion sources in a preferred embodiment of the present invention.

In a method for producing a sintered R-T-B based magnet according to the present invention, the step of providing at least one sintered R-T-B based magnet material (where R is a rare-earth element and T is either Fe alone or Fe and Co) and the step of providing a plurality of RH diffusion sources, each of which includes a heavy rare-earth element RH (which is Dy and/or Tb) and 30 mass % to 80 mass % of Fe and has a particle size of more than 53 μm and equal to or smaller than 5600 μm, are performed. Then, an arrangement process is performed to arrange the sintered R-T-B based magnet material and the plurality of RH diffusion sources in a process vessel so that some of the RH diffusion sources are in contact with the sintered R-T-B based magnet material.

Next, by carrying out a heat treatment on the sintered R-T-B based magnet material with which some of the RH diffusion sources are in contact, on the RH diffusion sources which are in contact with the sintered R-T-B based magnet material, and on the RH diffusion sources which are not in contact with the sintered R-T-B based magnet material, the heavy rare-earth element RH is made to diffuse from the RH diffusion sources into the sintered R-T-B based magnet material (i.e., an RH diffusion process is performed). In this RH diffusion process, a heat treatment is carried out in an inert ambient at a pressure of 5000 Pa or less and at a temperature of 800° C. to 1000° C.

After this RH diffusion process, a separation process is performed to separate the plurality of RH diffusion sources from the sintered R-T-B based magnet material. Since the RH diffusion sources that have been separated are recyclable, the RH diffusion sources may be collected and used again in the next RH diffusion process in a preferred embodiment.

According to the present invention, when some of the plurality of RH diffusion sources contact with the sintered R-T-B based magnet material and the other RH diffusion sources do not contact with the sintered R-T-B based magnet material, RH is supplied from the RH diffusion sources onto the surface of the sintered R-T-B based magnet material and is diffused inside the magnet material in parallel. In this description, when the RH diffusion sources "contact with" the sintered R-T-B based magnet material, the RH diffusion sources temporarily contact with the magnet material so as to be easily separable from the magnet material unlike a situation where a fine powder of an RH diffusion source is applied onto the surface of a magnet material. According to the conventional application method, the powder gets deposited or adheres onto, and is not easily separable from, the surface of the material.

The arrangement process described above may be the process step of arranging a single or a plurality of sintered R-T-B based magnet materials so that at least a portion of the sintered R-T-B based magnet material or at least some of the sintered R-T-B based magnet materials is/are buried in a set of RH diffusion sources. Also, the arrangement process may include the process step of arranging a plurality of sintered R-T-B based magnet materials and then arranging a plurality of RH diffusion sources so as to fill gaps between the sintered R-T-B based magnet materials. Furthermore, the arrangement process may include arranging the plurality of RH diffusion sources and the sintered R-T-B based magnet material using a jig to arrange the RH diffusion sources and the sintered R-T-B based magnet material and then moving the RH diffusion sources and the sintered R-T-B based magnet material along with the jig into a process vessel.

By arranging the sintered R-T-B based magnet material and RH diffusion sources with such a composition and size at those positions and heating them under the heat treatment process condition described above, a heavy rare-earth element RH is not only supplied directly from a point of contact between the sintered R-T-B based magnet material and the RH diffusion sources, but also vaporized and sublimed from the RH diffusion sources that do not contact with the sintered R-T-B based magnet material and then supplied, onto the surface of the sintered R-T-B based magnet material. In addition, the heavy rare-earth element RH is supplied from the RH diffusion sources onto the surface of the sintered R-T-B based magnet material and diffused inside the sintered R-T-B based magnet material in parallel with each other (which will be referred to herein as an "RH diffusion process").

In this description, a magnet body yet to be subjected to the RH diffusion process will be referred to herein as a "sintered R-T-B based magnet material" and a magnet body that has been subjected to the RH diffusion process will be referred to herein as a "sintered R-T-B based magnet".

According to the present invention, there is no need to perform a troublesome process step such as the process step of applying a solvent or tackiness agent, in which an RH powder is dispersed, onto the surface of a sintered R-T-B based magnet material. That is why the RH diffusion process can be carried out by arranging the sintered R-T-B based magnet material and the RH diffusion sources by a simpler method than the conventional one. As a result, the process can be shortened. In addition, since there is no need to arrange the sintered R-T-B based magnet material and the RH diffusion sources at predetermined positions, high productivity can be achieved, too.

Each of the RH diffusion sources according to the present invention is a rare-earth-iron alloy which has a relatively large particle size and includes RH and 30 mass % to 80 mass % of Fe. That is why in the RH diffusion process, the RH diffusion sources do not adhere to the sintered R-T-B based magnet easily and are recyclable over and over again.

Moreover, the RH diffusion sources according to the present invention include a lot of a compound of the heavy rare-earth element RH and iron, and therefore, do not react with the sintered R-T-B based magnet material easily. As there are only a small number of points of contact between the sintered R-T-B based magnet material and the RH diffusion sources, the heavy rare-earth element RH (which is at least one of Dy and Tb) will not be supplied onto the surface of the sintered R-T-B based magnet too much even when subjected to an RH diffusion process at a temperature of 800° C. to 1000° C. As a result, a sufficiently high $H_{cJ}$ can be obtained with the decrease in $B_r$ after the RH diffusion process minimized.

Hereinafter, an embodiment of a manufacturing process according to the present invention will be described in further detail.

Sintered R-T-B Based Magnet Material

First of all, according to the present invention, a sintered R-T-B based magnet material, in which a heavy rare-earth element RH needs to be diffused, is provided. The sintered R-T-B based magnet material may be a known one and may have the following composition, for example:

12 to 17 at % of rare-earth element R;

5 to 8% of B (part of which may be replaced with C);

0 to 2 at % of additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi) and T (which is a transition metal consisting mostly of Fe and which may include Co) and inevitably contained impurities as the balance.

where the rare-earth element R is at least one element which is mostly selected from the light rare-earth elements RL (Nd, Pr) but may include a heavy rare-earth element RH as well. If the heavy rare-earth element is included, at least one of Dy and Tb is suitably included.

The sintered R-T-B based magnet material with such a composition can be made by any arbitrary method.

RH Diffusion Source

An RH diffusion source according to the present invention is a rare-earth-iron alloy which includes a heavy rare-earth element RH (which is at least one of Dy and Tb) and 30 mass % to 80 mass % of Fe. As long as it falls within this composition range, the RH diffusion source includes a compound of a heavy rare-earth element RH such as $RHFe_2$ and iron as its main ingredient.

If the Fe content of the RH diffusion source were less than 30 mass %, then the RH diffusion source would adhere to the sintered R-T-B based magnet easily, thus possibly making the RH supply rate no longer stabilized or making the RH diffusion source not easily recyclable.

On the other hand, if the Fe content of the RH diffusion source were greater than 80 mass %, then the RH content would be less than 20 mass %, the heavy rare-earth element RH would be supplied from the RH diffusion source at a low rate, and it would take a long process time to achieve the effect of increasing the coercivity as intended. Consequently, such a method is not suitable for mass production.

The mass percentage of Fe included in the RH diffusion source of the present invention suitably falls within the range of 40 mass % to 60 mass % because Fe does not get modified easily in such a composition range. In that suitable range, the combined volume percentage of an $RHFe_2$ compound such as $DyFe_2$ and/or an $RHFe_3$ compound such as $DyFe_3$ included in the RH diffusion source becomes 90% or more. If the combined volume percentage of those compounds becomes equal to or greater than 90%, those compounds will hardly react with the sintered R-T-B based magnet body and will adhere to it even less easily.

Unless the effect of the present invention is lessened, the RH diffusion source may include not only Dy, Tb and Fe but also at least one element selected from the group consisting of Nd, Pr, La, Ce and Co. For example, the RH diffusion source may include, as inevitably contained impurities, 5 mass % or less of at least one element selected from the group consisting of Al, Ti, V, Cr, Mn, Ni, Cu, Ga, Nb, Mo, Zn, Zr, Sn, Ag, In, Hf, Ta, W, Pb, Si and Bi.

As the RH diffusion source of the present invention has a large particle size, its composition and particle size hardly change even after having gone through the RH diffusion process once. If the RH diffusion source is used over and over again, then its particle size is suitably controlled to fall within the range of more than 53 μm and equal to or smaller than 5600 μm.

The RH diffusion source according to the present invention may have any of various shapes including spherical, linear, plate-like, block and powder shapes, but have a particle size of more than 53 μm and equal to or smaller than 5600 μm. The RH diffusion source is classified by the method as defined in JIS Z 2510 using a sieve as defined in JIS Z 8801-1 to have its particle size adjusted to an intended one. A very small amount of (e.g., 10 mass % or less of) fine powder may be included inevitably because of an imperfect classification or deposition of such a fine powder on the particles with the size of more than 53 μm and equal to or smaller than 5600 μm. The RH diffusion source is made by any arbitrary method and may be obtained by cutting or pulverizing an ingot, slab or wire of an RH—Fe alloy with a predetermined composition.

If the RH diffusion source had a particle size of 53 μm or less, even the RH diffusion source with the composition of the present invention would adhere to the sintered R-T-B based magnet material easily, which is not beneficial to recycle the RH diffusion source. On the other hand, if the RH diffusion source had a particle size of more than 5600 μm, then the RH diffusion source would not diffuse uniformly over the sintered R-T-B based magnet body. For these reasons, the RH diffusion source suitably has a particle size of more than 100 μm and equal to or smaller than 4750 μm and more suitably has a particle size of more than 500 μm and equal to or smaller than 4000 μm.

Arrangement Process

In a preferred embodiment, the sintered R-T-B based magnet material and the RH diffusion sources are arranged so that some of the RH diffusion sources contact with at least a portion of the sintered R-T-B based magnet material. In this case, the sintered R-T-B based magnet material and the RH diffusion sources are suitably arranged so as not to leave any organic substance such as an organic solvent or tackiness agent between the RH diffusion sources themselves or between the RH diffusion source and the sintered R-T-B based magnet material. Thereafter, an RH diffusion process is performed by carrying out a heat treatment at a predetermined ambient pressure and at a predetermined temperature.

Hereinafter, it will be described with reference to FIG. 1 how to arrange the sintered R-T-B based magnet materials and RH diffusion sources.

The vessel 100 shown in FIG. 1 is a heat resistant container including a vessel body 10 with an opened top and a cap 20. The air can flow into and out of this vessel 100 through the gap between the body 10 and the cap 20. In the example illustrated in FIG. 1, a lot of RH diffusion sources 40 have been put onto the bottom of the vessel 100 to such a thickness as to prevent the sintered R-T-B based magnet materials 30 from contacting with the vessel 100. A number of sintered R-T-B based magnet materials 30 are arranged at some intervals over the set of RH diffusion sources 40. And by putting more RH diffusion sources 40 to the point that the sintered R-T-B based magnet materials 30 are hidden behind them, the sintered R-T-B based magnet materials 30 are entirely buried in that set of RH diffusion sources 40.

To increase $H_{cJ}$ by diffusing RH through the entire surface of the sintered R-T-B based magnet materials 30, the sintered R-T-B based magnet materials 30 are suitably surrounded entirely with the set of many RH diffusion sources 40 as shown in FIG. 1. The effect of the present invention can be achieved if the sintered R-T-B based magnet materials 30 are at least partially (e.g., 50% or more of the surface area of the sintered R-T-B based magnet materials) covered with the set of RH diffusion sources 40. Specifically, even if a portion of the sintered R-T-B based magnet materials 30 does not directly contact with the RH diffusion sources 40 due to contact of the sintered R-T-B based magnet materials 30 with the inner walls of the process vessel 100 or with each other, the effect of the present invention can also be achieved.

Figure 2:
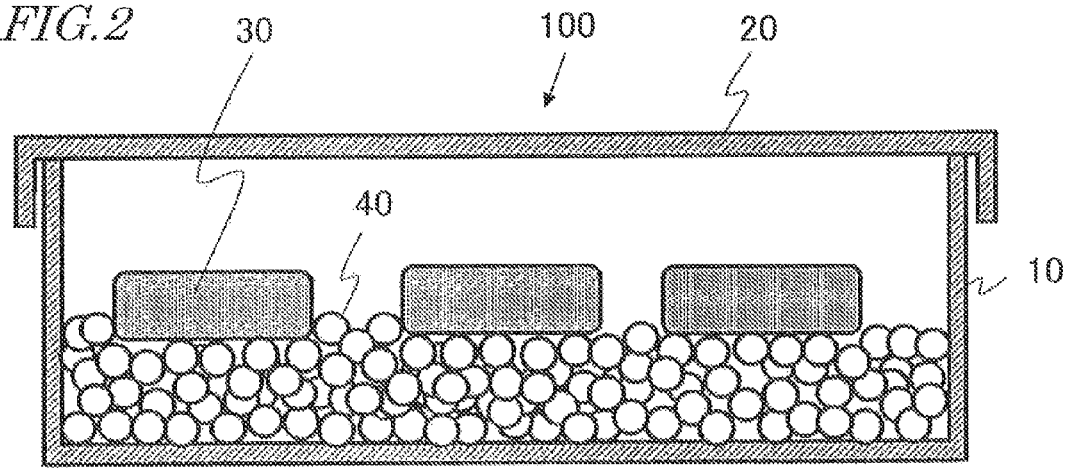
FIG. 2 Illustrates another exemplary arrangement of sintered R-T-B based magnet materials and RH diffusion sources in another preferred embodiment of the present invention.

According to the present invention, the sintered R-T-B based magnet materials 30 and RH diffusion sources 40 do not have to be arranged as shown in FIG. 1. Alternatively, the RH diffusion sources 40 may be arranged in the process vessel 100 and then the sintered R-T-B based magnet materials 30 may be mounted on the RH diffusion sources 40 as shown in FIG. 2.

Figure 3:
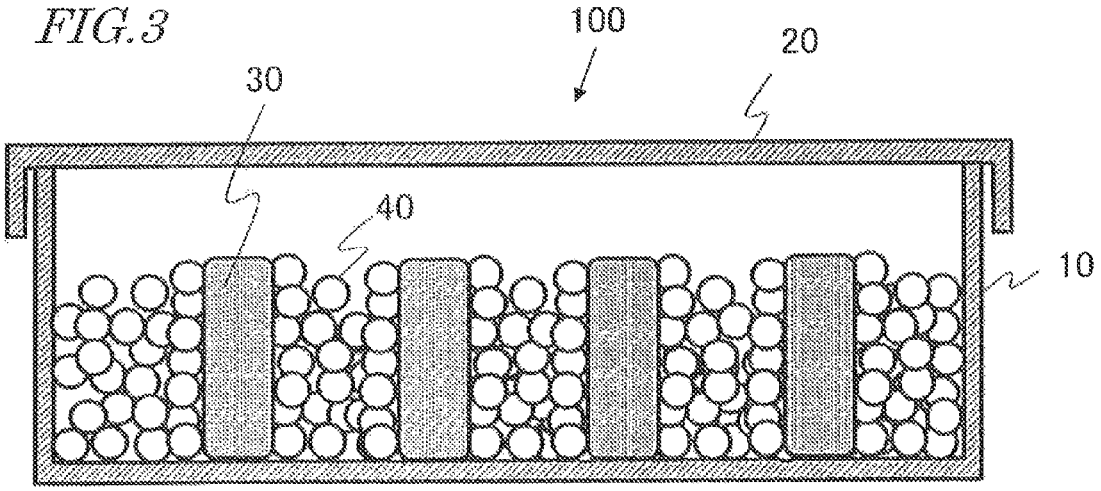
FIG. 3 Illustrates still another exemplary arrangement of sintered R-T-B based magnet materials and RH diffusion sources in still another preferred embodiment of the present invention.

Still alternatively, the sintered R-T-B based magnet materials 30 may be arranged in the process vessel 100 first, and then a lot of RH diffusion sources 40 may be poured to fill the gaps between the sintered R-T-B based magnet materials 30 as shown in FIG. 3.

Figure 4:
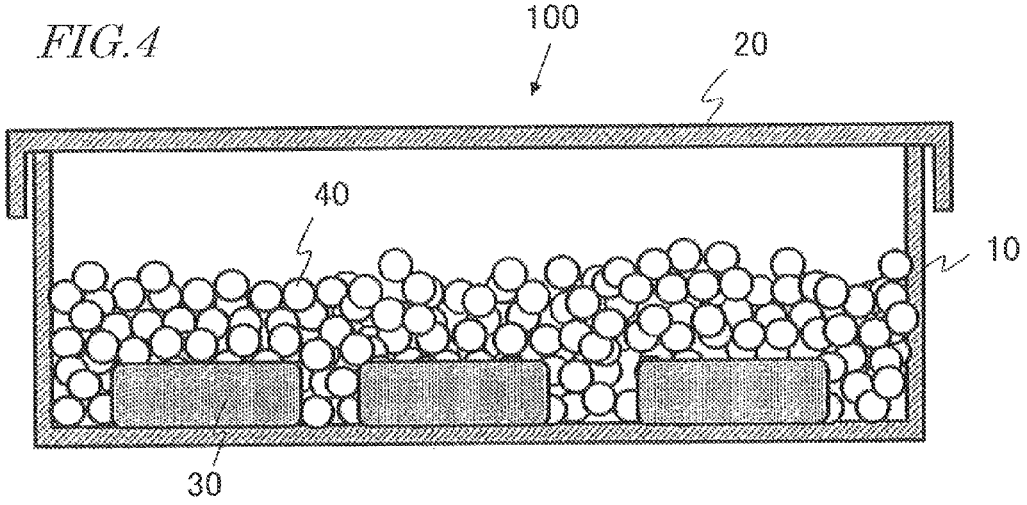
FIG. 4 Illustrates yet another exemplary arrangement of sintered R-T-B based magnet materials and RH diffusion sources in yet another preferred embodiment of the present invention.

Yet alternatively, the sintered R-T-B based magnet materials 30 may be arranged on the bottom of the process vessel 100 first, and then buried in a set of RH diffusion sources 40 as shown in FIG. 4.

Figure 5:
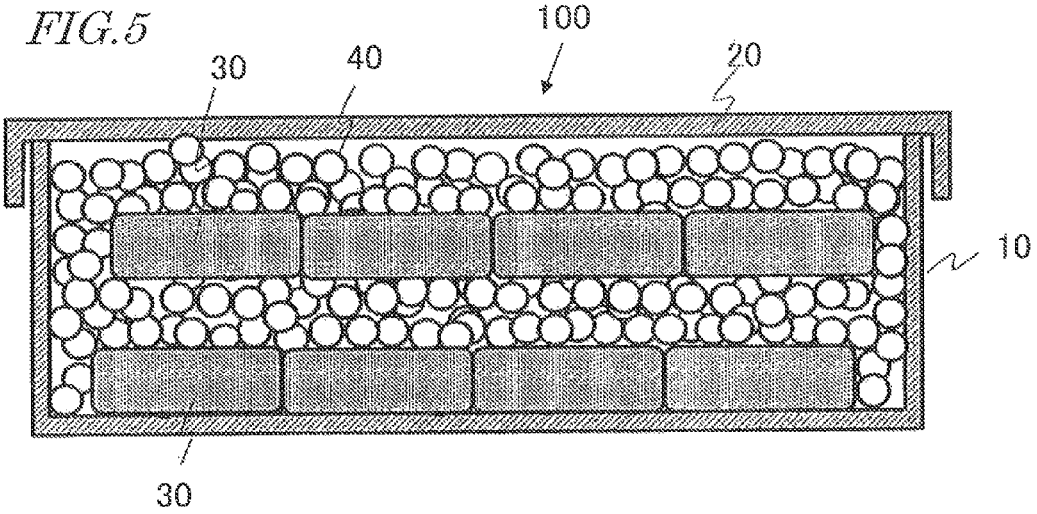
FIG. 5 Illustrates yet another exemplary arrangement of sintered R-T-B based magnet materials and RH diffusion sources in yet another preferred embodiment of the present invention.

Yet alternatively, the sintered R-T-B based magnet materials 30 may be arranged so as to be vertically stacked one upon the other by putting the RH diffusion sources 40 on the sintered R-T-B based magnet materials 30 and then mounting more sintered R-T-B based magnet materials 30 and more RH diffusion sources 40 on them as shown in FIG. 5.

The sintered R-T-B based magnet materials 30 may be arranged in any arbitrary direction. For example, if the sintered R-T-B based magnet materials 30 are plate magnets, the magnets may be arranged horizontally or vertically. On the other hand, if the sintered R-T-B based magnet materials 30 are small magnets, then the magnets may be scattered at random.

Figure 6A:
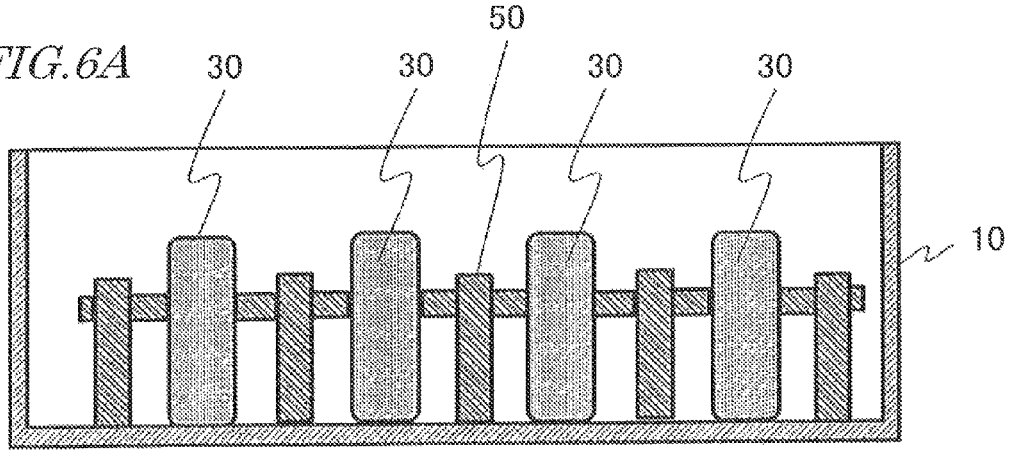
FIG. 6A Illustrates an exemplary configuration for a jig which can be used in a preferred embodiment of the present invention.
Figure 6B:
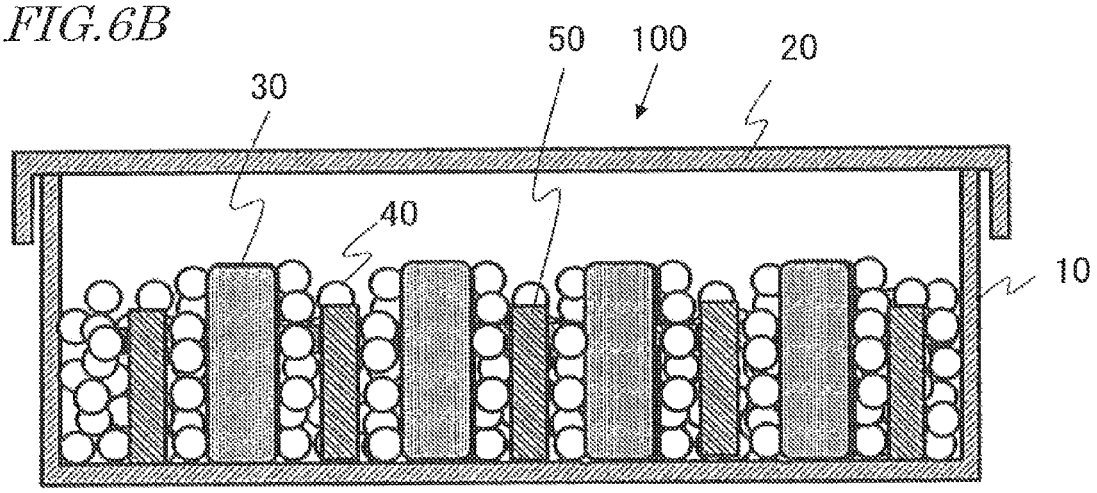
FIG. 6B Illustrates an exemplary arrangement of a jig, sintered R-T-B based magnet bodies and RH diffusion sources in a preferred embodiment of the present invention.

If the sintered R-T-B based magnet materials 30 are arranged at regular intervals, not only the sintered R-T-B based magnet materials 30 and the RH diffusion sources 40 but also a jig to assist the arrangement work may be present in the process vessel 100. For example, after the sintered R-T-B based magnet materials 30 have been arranged at appropriate intervals using an auxiliary jig, the RH diffusion sources 40 may be introduced. FIG. 6A schematically illustrates a state in which the sintered R-T-B based magnet materials 30 are arranged at appropriate intervals using a jig 50. As long as it has heat resistance, the jig does not have to have the configuration shown in FIG. 6A but may have any of various other configurations. FIG. 6B illustrates how a lot of RH diffusion sources 40 may be introduced into the process vessel 100 in which the jig 50 and the sintered R-T-B based magnet materials 30 have been arranged in advance.

According to the present invention, the RH diffusion sources 40 can be brought into contact with the surface of the sintered R-T-B based magnet materials 30 with good stability without applying a tackiness agent onto the surface.

The process vessel 100 is made of a heat resistant metal or alloy such as SUS material, Ti, Mo, Nb, an Fe—Cr—Al alloy or an Fe—Co—Cr alloy. The process vessel 100 may have any arbitrary shape and may have a box shape or a cylindrical shape, for example. Optionally, the entire heat treatment furnace may be used as the process vessel 100. Considering the work efficiency, however, it is still preferred that after the sintered R-T-B based magnet materials 30 and RH diffusion sources 40 have been arranged in the process vessel 100 outside of the heat treatment furnace, the process vessel 100 be loaded into the heat treatment furnace. The process vessel 100 is configured to allow the air to flow into and out of the vessel 100 and to control the ambient inside of the vessel 100.

In a preferred embodiment of the present invention, the RH diffusion sources 40 are used as they are without being dispersed or dissolved in a solvent. Since no solvent or tackiness agent is used, no substances other then the RH diffusion sources 40 and the ambient gas are present at any time between the RH diffusion sources 40 and between the RH diffusion sources 40 and the sintered R-T-B based magnet materials 30. That is why RH that has vaporized and sublimed from the RH diffusion sources 40 that do not contact with the sintered R-T-B based magnet materials 30 can be supplied onto the surface of the sintered R-T-B based magnet materials 30 without being interfered with at all.

In this case, the set of RH diffusion sources 40 that contacts with the sintered R-T-B based magnet materials 30 suitably has a thickness of 500 μm or more, and more suitably has a thickness of 1000 μm or more. If a plurality of sintered R-T-B based magnet materials are arranged, the set of RH diffusion sources 40 faced by the sintered R-T-B based magnet materials has its thickness as measured from their opposing surface defined by the distance between the sintered R-T-B based magnet materials.

By covering the sintered R-T-B based magnet materials 30 with such a thick layer of RH diffusion sources 40 without using any organic substance in this manner, the effect of diffusion from the points of contact between the sintered R-T-B based magnet materials 30 and the RH diffusion sources 40 and the effect of diffusion from the RH diffusion sources 40 that do not contact with the sintered R-T-B based magnet materials 30 can be both achieved more easily. In addition, the arrangement work can get done more easily and more efficiently, thus realizing high productivity.

Ambient

The ambient when the RH diffusion process is carried out is suitably an inert gas ambient and the ambient gas is supposed to have a pressure of 5000 Pa or less. According to the present invention, the size of the RH diffusion sources is set to be relatively large and the number of points of contact between the RH diffusion sources and the sintered R-T-B based magnet materials is reduced, and therefore, the amount of RH that diffuses inside the sintered R-T-B based magnet materials directly from their point of contact with the RH diffusion sources is relatively small. However, by setting the pressure of the ambient gas during the RH diffusion process to be 5000 Pa or less, RH will also vaporize and sublime from a portion of the RH diffusion sources that does not contact with the sintered R-T-B based magnet materials, will be supplied onto the surface of the sintered R-T-B based magnet materials, and will diffuse inside the sintered R-T-B based magnet materials. By causing not only this diffusion but also the diffusion from the points of their contact in parallel, the RH diffusion process can be carried out highly efficiently. The RH diffusion process may be carried out with the lower limit of the ambient gas pressure set to be about $10^{-3}$ Pa. However, if the ambient gas pressure were too low, the RH diffusion sources could adhere to the sintered R-T-B based magnet materials easily. For that reason, the lower limit of the ambient gas pressure is suitably 0.1 Pa, more suitably 5 Pa.

Heat Treatment Temperature

The temperature of the heat treatment to be carried out during the RH diffusion process is supposed to be 800° C. to 1000° C. This is a temperature range which is suitable for the heavy rare-earth element RH to diffuse inward through the grain boundary phase of the sintered R-T-B based magnet material.

The RH diffusion sources are made of a heavy rare-earth element RH and 30 mass % to 80 mass % of Fe, and the RH metal will not be supplied excessively at a temperature of 800° C. to 1000° C.

If the heat treatment temperature were lower than 800° C., the RH element to vaporize and sublime would be too little to cause diffusion easily. As a result, the coercivity could not be increased as effectively as intended or it would take too long a time to get the RH diffusion process done in order to achieve the effect of increasing the coercivity as intended. None of these are favorable situations. On the other hand, if the heat treatment temperature were higher than 1000° C., then the sintered R-T-B based magnet materials would adhere to the RH diffusion sources easily, which is a problem, too.

The heat treatment time is determined with the weight ratio of the sintered R-T-B based magnet materials to the RH diffusion sources loaded during the RH diffusion process, the shape of the sintered R-T-B based magnet materials, the shape of the RH diffusion sources, the amount of the heavy rare-earth element RH to be diffused into the sintered R-T-B based magnet materials through the RH diffusion process (which will be referred to herein as a "diffusion rate") and other factors taken into account. The heat treatment time may be 10 minutes to 72 hours, for example, and is suitably 1 to 12 hours.

First Heat Treatment

Optionally, after the RH diffusion process, the sintered R-T-B based magnet materials may be subjected to a first heat treatment in order to distribute more uniformly the heavy rare-earth element RH diffused. In that case, after the RH diffusion sources have been collected, the first heat treatment is carried out within the temperature range of 700° C. to 1000° C. in which the heavy rare-earth element RH can diffuse substantially, more suitably within the range of 850° C. to 950° C. In this first heat treatment, the heavy rare-earth element RH does diffuse inside of the sintered R-T-B based magnet materials. As a result, the heavy rare-earth element RH that has been introduced into a surface region of the sintered magnet by diffusion can diffuse to reach an even deeper level, and the magnets as a whole can eventually have increased $H_{cJ}$. The first heat treatment may be carried out for a period of time of 10 minutes to 72 hours, for example, and suitably for 1 to 12 hours.

In this case, the first heat treatment may be carried out in either a vacuum or an inert gas ambient, and the ambient gas pressure is suitably equal to or lower than the atmospheric pressure.

Second Heat Treatment

Also, if necessary, a second heat treatment may be further carried out at a temperature of 400° C. to 700° C. However, if the first heat treatment and the second heat treatment (at 400° C. to 700° C.) are both conducted, it is recommended that the second heat treatment be carried out after the first heat treatment (at 700° C. to 1000° C.). The RH diffusion process and the first heat treatment (at 700° C. to 1000° C.) and the second heat treatment (at 400° C. to 700° C.) may be performed in the same processing chamber. The second heat treatment may be performed for a period of time of 10 minutes to 72 hours, and suitably performed for 1 to 12 hours. Optionally, only this second heat treatment may be carried out with the first heat treatment omitted.

In this case, the second heat treatment may be carried out in either a vacuum or an inert gas ambient, and the ambient gas pressure is suitably equal to or lower than the atmospheric pressure.

As can be seen, by performing the RH diffusion process with the composition and size of the RH diffusion sources, the pressure of the ambient gas during the RH diffusion process, and the heat treatment temperature set within appropriate ranges and with the sintered R-T-B based magnet materials and RH diffusion sources arranged as described above, RH can be diffused directly from the points of contact between the sintered R-T-B based magnet materials and the RH diffusion sources and RH can also vaporize and sublime from a portion of the RH diffusion sources that does not contact with the sintered R-T-B based magnet materials and be supplied onto the surface of the sintered R-T-B based magnet materials highly efficiently.

Recycling of the RH Diffusion Sources

The RH diffusion sources according to the present invention are a rare-earth-iron alloy which has a relatively large particle size and which includes RH and 30 mass % to 80 mass % of Fe, and therefore, will not adhere to the sintered R-T-B based magnet materials easily during the RH diffusion process, and can be easily separated and collected. In addition, even after having gone through the RH diffusion process, the RH diffusion sources have their composition and particle size hardly changed. That is why the RH diffusion sources can be used over and over again for sintered R-T-B based magnet materials that have not been used in (i.e., that have not yet been subjected to) the RH diffusion process. The RH diffusion sources can be recycled as they are even without being subjected to any special treatment, and therefore, the rare and expensive RH can be used non-wastefully. Optionally, new RH diffusion sources that have never been used in the RH diffusion process may also be added as well.

EXAMPLES

Experimental Example 1

First of all, a sintered R-T-B based magnet material, having a composition consisting of 30.0 mass % of Nd, 0.5 mass % of Dy, 1.0 mass % of B, 0.9 mass % of Co, 0.1 mass % of Al, 0.1 mass % of Cu, and Fe as the balance, was made. Next, the sintered magnet material was machined, thereby obtaining plate sintered R-T-B based magnet materials with a size of 30 mm×30 mm×3 mm. The magnetic properties of the sintered R-T-B based magnet materials thus obtained were measured with a B—H tracer. As a result, their $H_{cJ}$ was 1050 kA/m and their $B_r$ was 1.40 T. The magnetic properties were measured after a heat treatment, corresponding to the second heat treatment to be described later, had been carried out at 500° C. for three hours.

Next, RH diffusion sources, of which the compositions and sizes were as shown in the following Table 1, were provided. The RH diffusion sources were obtained by pulverizing slabs of an RH—Fe alloy that had been made by melt-quenching process with a pin mill and then sorting out a powder with the particle sizes shown in Table 1 by classification. The classification was carried out by the method defined by JIS Z 2510 using an automatic sieve shaker. Specifically, the powder was classified with sieves, of which the opening sizes as defined by JIS Z 8801-1 were 53 μm, 300 μm, 500 μm, 850 μm, 2000 μm and 5600 μm.

TABLE 1

| | RH diffusion source | | | | Diffusion | Ambient | Diffusion | | | Did |
|---|---|---|---|---|---|---|---|---|---|---|
| Sample No | Dy (mass %) | Tb (mass %) | Fe (mass %) | Size (μm) | temperature (° C.) | pressure (Pa) | time (hours) | $\Delta H_{cJ}$ (kA/m) | ΔBr (T) | adhesion occur? |
| 1 | 70 | | 30 | 500-850 | 900 | 100 | 6 | 420 | −0.005 | NO |
| 2 | 60 | | 40 | 500-850 | 900 | 100 | 6 | 420 | 0 | NO |
| 3 | 55 | | 45 | 53-300 | 850 | 100 | 6 | 230 | 0 | NO |
| 4 | 55 | | 45 | 53-300 | 900 | 100 | 6 | 390 | 0 | NO |
| 5 | 55 | | 45 | 53-300 | 950 | 100 | 6 | 480 | 0 | NO |
| 6 | 55 | | 45 | 500-850 | 850 | 100 | 6 | 290 | 0 | NO |
| 7 | 55 | | 45 | 500-850 | 900 | 1 | 6 | 440 | 0 | NO |
| 8 | 55 | | 45 | 500-850 | 900 | 100 | 6 | 420 | 0 | NO |
| 9 | 55 | | 45 | 500-850 | 900 | 5000 | 6 | 330 | 0 | NO |
| 10 | 55 | | 45 | 500-850 | 950 | 100 | 6 | 500 | 0 | NO |
| 11 | 55 | | 45 | 500-850 | 950 | 100 | 9 | 520 | 0 | NO |
| 12 | 55 | | 45 | 500-850 | 980 | 100 | 6 | 520 | 0 | NO |
| 13 | 55 | | 45 | 500-850 | 980 | 100 | 9 | 540 | 0 | NO |
| 14 | 55 | | 45 | 2000-5600 | 850 | 100 | 6 | 250 | 0 | NO |
| 15 | 55 | | 45 | 2000-5600 | 900 | 100 | 6 | 420 | 0 | NO |
| 16 | 55 | | 45 | 2000-5600 | 950 | 100 | 6 | 490 | 0 | NO |
| 17 | 50 | | 50 | 500-850 | 900 | 100 | 6 | 400 | 0 | NO |
| 18 | 40 | | 60 | 500-850 | 900 | 100 | 6 | 390 | 0 | NO |
| 19 | 20 | | 80 | 500-850 | 900 | 100 | 6 | 200 | 0 | NO |
| 20 | 10 | | 90 | 500-850 | 900 | 100 | 6 | 20 | 0 | NO |
| 21 | | 60 | 40 | 500-850 | 900 | 100 | 6 | 200 | 0 | NO |
| 22 | 30 | 30 | 40 | 500-850 | 900 | 100 | 6 | 300 | 0 | NO |
| 23 | 55 | | 45 | 500-850 | 900 | 100 | 6 | 350 | 0 | NO |
| 24 | 100 | | | 500-850 | 900 | 100 | 6 | — | — | YES |
| 25 | | 100 | | 500-850 | 900 | 100 | 6 | — | — | YES |
| 26 | 80 | | 20 | 500-850 | 900 | 100 | 6 | — | — | YES |
| 27 | 55 | | 45 | 53 or less | 900 | 100 | 6 | — | — | YES |
| 28 | 55 | | 45 | 500-850 | 700 | 100 | 6 | 30 | 0 | NO |
| 29 | 55 | | 45 | 500-850 | 1050 | 100 | 6 | — | — | YES |

After the sintered R-T-B based magnet materials and RH diffusion sources had been provided as described above, the sintered R-T-B based magnet materials and RH diffusion sources were arranged in a process vessel as in the example shown in FIG. 1. Specifically, RH diffusion sources were put to a thickness of 1 to 5 mm on the bottom of a box process vessel made of SUS with dimensions of 300 mm×150 mm×100 mm, 10 sintered R-T-B based magnet materials were arranged over the RH diffusion sources with some space left between them, RH diffusion sources were further introduced until the sintered R-T-B based magnet materials were hidden behind the RH diffusion sources, and then the cap was closed. The process vessel in which the sintered R-T-B based magnet materials and the RH diffusion sources had been arranged was loaded into a heat treatment furnace and then subjected to a heat treatment within an Ar ambient at the ambient pressure, diffusion temperature and diffusion time shown in Table 1.

The heat treatment was carried out so as to increase the temperature from room temperature while evacuating the process vessel and to start performing an RH diffusion process at the diffusion time and diffusion temperature shown in Table 1 when the pressure and temperature of the ambient reached the ones shown in Table 1. Thereafter, after the temperature was lowered to room temperature once, the process vessel was unloaded, and the sintered R-T-B based magnet materials and RH diffusion sources were separated and collected. In this example, the sintered R-T-B based magnet materials and RH diffusion sources could be easily separated from each other in Samples #1 through #23 and #28, but the RH diffusion sources had adhered to the surface of the sintered R-T-B based magnet materials and could not be separated in Samples #24 through #27 and #29.

The sintered R-T-B based magnet materials collected were re-introduced into the process vessel, which was then loaded into the heat treatment furnace again. After that, as in the RH diffusion process, the temperature was raised while the process vessel was evacuated. And when the temperature reached a first heat treatment temperature, the first heat treatment was carried out with the first heat treatment temperature maintained for a predetermined period of time. Thereafter, after the temperature was lowered to room temperature once, the temperature was raised again to the second heat treatment temperature. And when the temperature reached the second heat treatment temperature, the second heat treatment was carried out with the second heat treatment temperature maintained for a predetermined period of time. In this example, the first heat treatment was conducted at 900° C. for three hours, while the second heat treatment was conducted at 500° C. for three hours. Sample #23 was subjected to only the second heat treatment without being subjected to the first heat treatment. These conditions for the first and second heat treatments are just an example.

The magnetic properties of those Samples #1 through #23 and #28, in which the sintered R-T-B based magnet materials and RH diffusion sources could be separated and collected, were measured with a B—H tracer, and the magnitudes of variations in HcJ and Br were obtained. The results are shown in Table 1.

As for Samples #1 through #19 and Samples #21 through #23, it was confirmed that when the Fe content of the RH diffusion sources was 30 mass % to 80 mass % and the RH diffusion process temperature was 800° C. to 1000° C., $B_r$ did not decrease significantly and $H_{cJ}$ increased by 50 kA/m or more.

Figure 7:
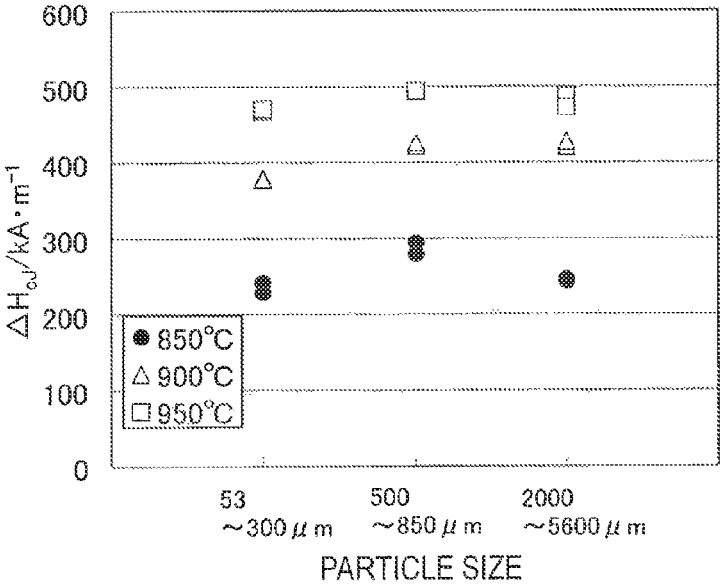
FIG. 7 A graph showing how Hr varied according to the size of the RH diffusion sources and the temperature of the RH diffusion process in Samples #3 to #5, #6, #8, #10, and #14 to #16.

FIG. 7 shows how $H_{cJ}$ varied according to the size of the RH diffusion sources and the temperature of the RH diffusion process in Samples #3 to #5, #6, #8, #10, and #14 to #16. It was confirmed that in each of these samples, $H_{cJ}$ could be increased by 50 kA/m or more without causing a significant decrease in $B_r$.

Figure 8:
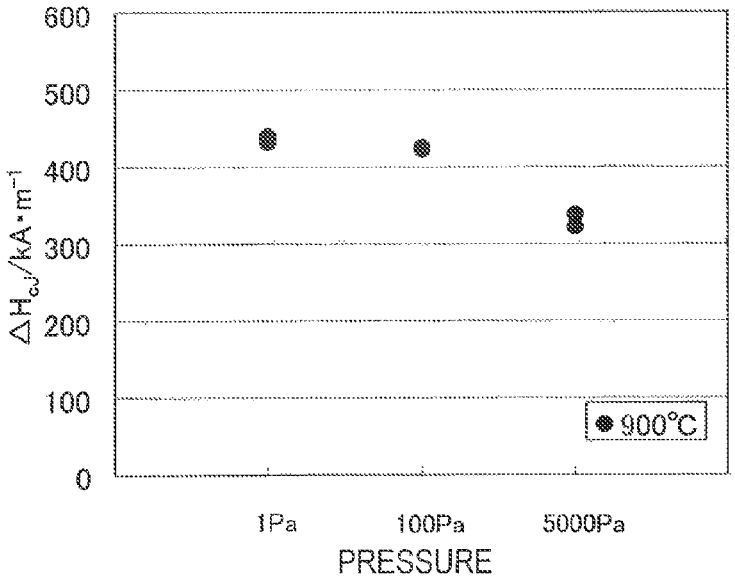
FIG. 8 A graph showing how $H_{cJ}$ changed with the pressure of the ambient gas in Samples #7 through #9.

FIG. 8 shows how $H_{cJ}$ changed with the pressure of the ambient gas in Samples #7 through #9. It was confirmed that in each of these samples, $H_{cJ}$ could be increased by 50 kA/m or more without causing a significant decrease in $B_r$.

Experimental Example 2

After the RH diffusion process had been carried out as on Samples #1 through #23 of Experimental Example 1, the sintered R-T-B based magnet materials were unloaded from the process vessel and the sintered R-T-B based magnet materials and RH diffusion sources were separated from each other and collected. Next, the RH diffusion process was carried out in the same way as in Experimental Example 1 using the same sintered R-T-B based magnet materials as what was provided first in Experimental Example 1 and the RH diffusion sources collected, and then the magnetic properties were measured in the same way as in Experimental Example 1. As a result, it was confirmed that in each and every one of those samples, $H_{cJ}$ could be increased by as much as in Experimental Example 1 without causing a significant decrease in $B_r$.

Experimental Example 3

Figure 9:
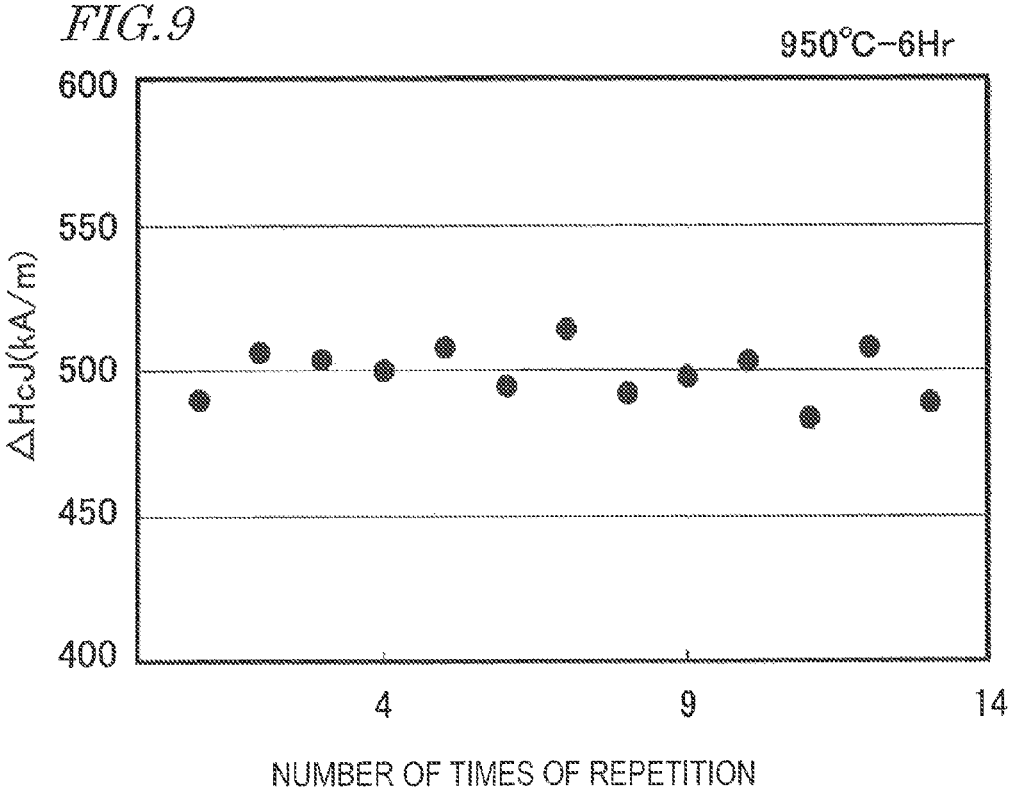
FIG. 9 A graph showing how $H_{cJ}$ changed with the number of times the same RH diffusion process was carried out repeatedly.

After the RH diffusion process had been carried out as on Sample #10 of Experimental Example 1, the sintered R-T-B based magnet materials were unloaded from the process vessel and the sintered R-T-B based magnet materials and RH diffusion sources were separated from each other and collected. Next, the RH diffusion process was carried out in the same way as in Experimental Example 1 using the same sintered R-T-B based magnet materials as what was provided first in Experimental Example 1 and the RH diffusion sources collected. After that, the RH diffusion process was repeatedly carried out eleven more times. That is to say, the RH diffusion process was carried out thirteen times in total. FIG. 9 is a graph showing how $H_{cJ}$ changed with the number of times the same RH diffusion process was carried out repeatedly. It was confirmed that $H_{cJ}$ could be increased by as much as in Experimental Example 1 even if the same RH diffusion sources were used over and over again.

INDUSTRIAL APPLICABILITY

The present invention uses a rare and expensive heavy rare-earth element efficiently, and therefore, can be used effectively to mass-produce sintered R-T-B based magnets with excellent magnetic properties.

REFERENCE SIGNS LIST

10 process vessel
20 cap
30 sintered R-T-B based magnet material
40 RH diffusion source
100 process vessel

The invention claimed is:

1. A method for producing a sintered R-T-B based magnet, the method comprising the steps of:

providing at least one sintered R-T-B based magnet material, where R is a rare-earth element and T is either Fe alone or Fe and Co;

providing a plurality of RH diffusion sources each of which includes a heavy rare-earth element RH, the RH is Dy and/or Tb, and 30 mass % to 80 mass % of Fe and which has a particle size of more than 53 μm and equal to or smaller than 5600 μm;

performing an arrangement process to arrange the sintered R-T-B based magnet material and the plurality of RH diffusion sources in a process vessel so that some of the RH diffusion sources are in contact with the sintered R-T-B based magnet material;

performing an RH diffusion process by carrying out a heat treatment in an inert ambient at a pressure of 5000 Pa or less and at a temperature of 800° C. to 1000° C. in the process vessel on the sintered R-T-B based magnet material with which some of the RH diffusion sources are in contact, on the RH diffusion sources which are in contact with the sintered R-T-B based magnet material, and on the RH diffusion sources which are not in contact with the sintered R-T-B based magnet material; and performing a separation process to separate the plurality of RH diffusion sources from the sintered R-T-B based magnet material after the RH diffusion process has been performed; wherein the arrangement process includes arranging the plurality of RH diffusion sources and the sintered R-T-B based magnet material using a jig to arrange the RH diffusion sources and the sintered R-T-B based magnet material and then moving the RH diffusion sources and the sintered R-T-B based magnet material along with the jig into the process vessel.

* * * * *